US010240426B2

(12) United States Patent
Grace et al.

(10) Patent No.: US 10,240,426 B2
(45) Date of Patent: Mar. 26, 2019

(54) PRESSURIZING ROTATING CONTROL DEVICES

(71) Applicant: Halliburton Energy Services, Inc., Houston, TX (US)

(72) Inventors: Christopher Allen Grace, Fort Worth, TX (US); Raymond Ronald Bullock, Hoveton Norfolk (GB); Joseph Michael Karigan, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 16 days.

(21) Appl. No.: 15/323,169

(22) PCT Filed: Aug. 19, 2015

(86) PCT No.: PCT/US2015/045967
§ 371 (c)(1),
(2) Date: Dec. 30, 2016

(87) PCT Pub. No.: WO2016/028937
PCT Pub. Date: Feb. 25, 2016

(65) Prior Publication Data

US 2017/0159395 A1 Jun. 8, 2017

Related U.S. Application Data

(60) Provisional application No. 62/039,232, filed on Aug. 19, 2014.

(51) Int. Cl.
*E21B 33/08* (2006.01)
*E21B 23/04* (2006.01)
(Continued)

(52) U.S. Cl.
CPC ..... *E21B 33/085* (2013.01); *E21B 21/08* (2013.01); *E21B 23/04* (2013.01); *E21B 33/06* (2013.01)

(58) Field of Classification Search
CPC ..... E21B 33/085; E21B 21/08; E21B 23/04; E21B 33/06
See application file for complete search history.

(56) References Cited

U.S. PATENT DOCUMENTS 4,143,881 A 3/1979 Bunting
5,348,107 A 9/1994 Bailey et al.
(Continued)

FOREIGN PATENT DOCUMENTS

EP 2261457 A2 12/2010
WO 2016028937 A1 2/2016

*Primary Examiner* — Yong-Suk Ro
(74) *Attorney, Agent, or Firm* — John W. Wustenberg; Parker Justiss, P.C.

(57) ABSTRACT

A rotating control device (RCD), for use in drilling a wellbore, includes an RCD body, a sealing element, and a bearing assembly disposed within the RCD body and supporting an inner mandrel to rotate relative to the RCD body. The sealing element is carried by the inner mandrel, and the bearing assembly includes a bearing sealed in an internal bearing fluid chamber. The internal bearing fluid chamber includes a bearing fluid maintained at a pressure greater than a pressure of wellbore fluid in an interior of the RCD body by a pressure compensating piston between the bearing fluid contacting a first end of the piston and the wellbore fluid contacting a second, opposite end of the piston.

15 Claims, 6 Drawing Sheets

(51) Int. Cl.
*E21B 21/08* (2006.01)
*E21B 33/06* (2006.01)

(56) References Cited

U.S. PATENT DOCUMENTS

| | | | | |
|---|---|---|---|---|
| 5,662,181 | A | 9/1997 | Williams et al. | |
| 6,138,774 | A * | 10/2000 | Bourgoyne, Jr. | E21B 21/001 175/214 |
| 2006/0144622 | A1* | 7/2006 | Bailey | E21B 33/085 175/230 |
| 2008/0210471 | A1* | 9/2008 | Bailey | E21B 21/08 175/48 |
| 2009/0139724 | A1* | 6/2009 | Gray | E21B 23/04 166/345 |
| 2011/0036638 | A1* | 2/2011 | Sokol | E21B 21/106 175/325.3 |
| 2012/0000664 | A1* | 1/2012 | Nas | E21B 33/085 166/344 |
| 2012/0177313 | A1 | 7/2012 | Beauchamp et al. | |
| 2015/0315845 | A1* | 11/2015 | Chambers | E21B 3/04 166/379 |

* cited by examiner

PRESSURIZING ROTATING CONTROL DEVICES

CROSS-REFERENCE TO RELATED APPLICATION

This application is the National Stage of, and therefore claims the benefit of, International Application No. PCT/US2015/045967 filed on Aug. 19, 2015, entitled "PRESSURIZING ROTATING CONTROL DEVICES," which was published in English under International Publication Number WO 2016/028937 on Feb. 25, 2016, and has a priority date of Aug. 19, 2014, based on application 62/039,232. Both of the above applications are commonly assigned with this National Stage application and are incorporated herein by reference in their entirety.

BACKGROUND

In the oil and gas industry a rotating control device (RCD) or rotating control head (also referred to as a rotating drilling device, rotating drilling head, rotating flow diverter, pressure control device and rotating annular) is used to form a seal against drill pipe and isolate the region of well bore below the RCD from whatever is above the RCD. On an offshore drilling rig the RCD may be located just below the rig floor, just above the subsea Blow Out Preventer stack (BOP), or anywhere in the riser. Typically, the RCD uses a passive or active sealing element which is mounted to a bearing assembly to form a seal on the drill pipe. The purpose of the bearing assembly is to allow the sealing element to rotate with the drill pipe as the drill pipe is rotated by the rig.

DESCRIPTION OF DRAWINGS

Like reference symbols in the various drawings indicate like elements.

DETAILED DESCRIPTION

Figure 1:
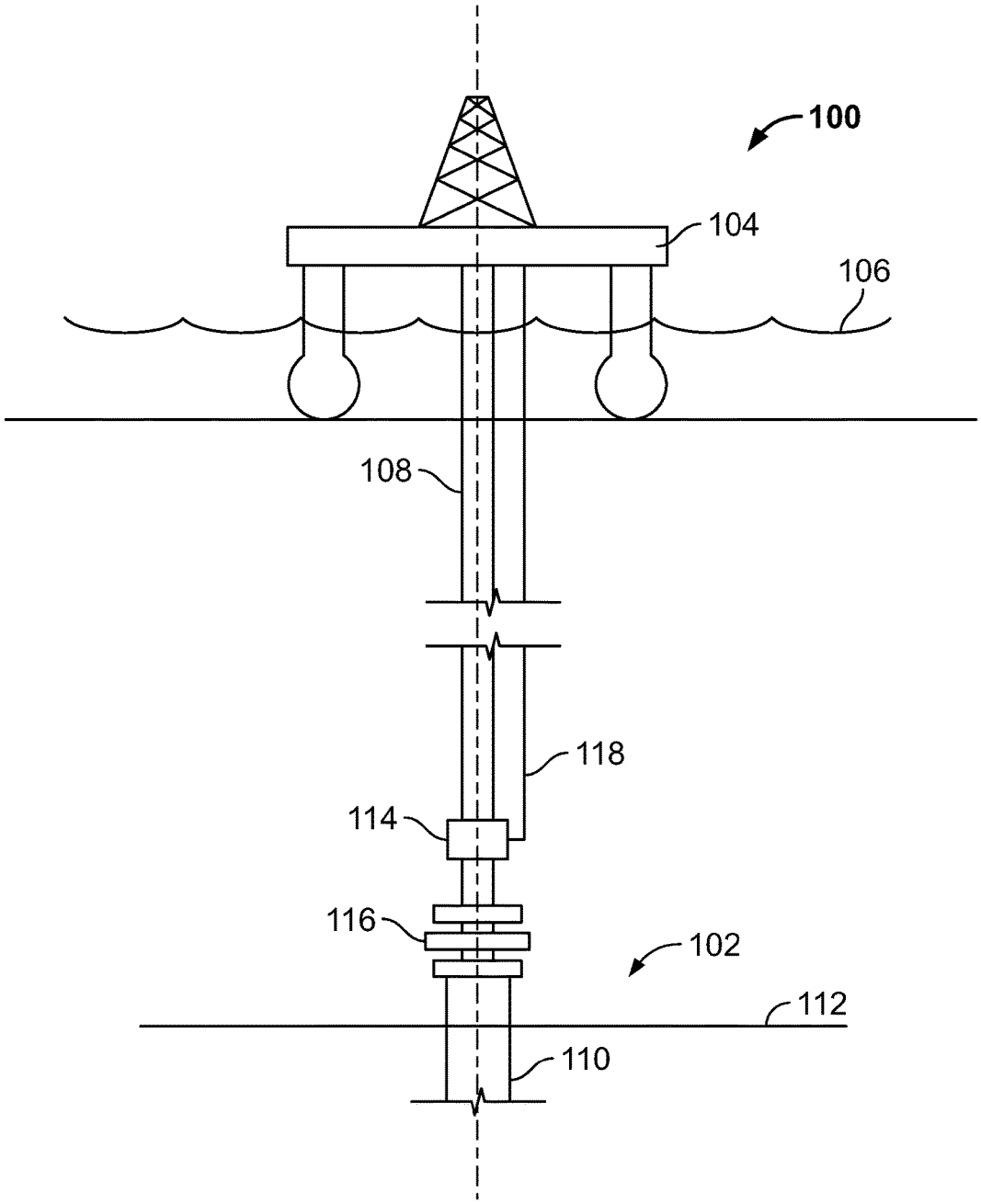
FIG. 1 is a schematic of an example drilling system with a RCD.

Referring first to FIG. 1, a drilling system 100 is shown drilling subsea well 102. A tubular drilling string (not shown) extends downward from a drilling vessel 104 at the water's surface 106, through a tubular riser 108 and into a wellbore 110 being drilled by the drilling string at the sea floor 112. The riser 108 includes the RCD 114 intermediate the Blow Out Preventer stack (BOP) 116 and the vessel 104. The RCD 114 can be integral to the riser 108, mounted to the riser 108, or otherwise connected to the riser 108. Although shown in FIG. 1 as submerged, immediately above or coupled to the blowout preventer (BOP) stack 116, the RCD 114 can be located anywhere along the riser 108. For example, the RCD 114 can be located above the water's surface 106 immediately below the floor of the vessel 104, just below a riser tension ring, just above the riser tension ring, or another location in the riser 108. In certain instances, such as with a drill rig on an Earth surface, the RCD 114 is above the Earth surface and immediately below the floor of the drill rig. During drilling, drilling fluid is circulated between the rig and the location of drilling (e.g., the drill bit), typically downward through the drilling string and back up through the annulus between the drilling string and the wall of the wellbore 110 and the annulus between the drilling string and the riser 108. The RCD 114 includes a sealing element that seals to the drilling string to control flow of drilling fluid through the annulus between the drilling string and the riser 108. The sealing element is supported on a bearing assembly to allow the sealing element to rotate with the drilling string relative to the remainder of the riser 108. In certain instances, the RCD 114 has a drilling fluid bypass line 118 (i.e., diversion line) below the sealing element to allow drilling fluid to bypass the riser 108 above the RCD 114 and flow to another location, such as the drilling vessel 104. In some instances, the fluid bypass line 118 flows drilling fluid (e.g., return fluid from the wellbore 110) to a choke manifold, for example, to allow better control of the drilling fluid pressure, enabling managed pressure drilling.

As mentioned above, rotating control devices (RCD) use a passive or active sealing element which is carried by a bearing assembly to form a seal on the drill pipe. The bearing assembly can include multiple types of bearing components to withstand the various loading conditions that may act on the RCD. To maximize the life and performance of the bearing and other bearing components of the bearing assembly, the bearing assembly is filled with some type of bearing fluid (e.g., lubricating fluid, such as hydraulic oil, grease, or other). The bearing fluid is held at a pressure that is greater than the well bore pressure (i.e., pressure of wellbore fluid in the wellbore) so that drilling mud and other contamination do not enter the bearing assembly; instead, the internal bearing assembly fluid leaks into the well bore with time, for example, across a dynamic seal sealing the bearing assembly from fluid from the wellbore. On land based rigs or other rigs where the RCD is located near the rig floor, a control line can be used that communicates fluid pressure to the bearing assembly to maintain proper internal bearing pressure. Using an external control line to maintain bearing pressure on a rig where the RCD is located far from the rig floor, like a DP (dynamic positioning) drill ship or semi-submersible drilling unit, can be very difficult and costly. The concepts herein eliminate the control line and/or locate a pressure compensation system in or very near the RCD. Thus, the bearing pressure can be created and controlled without the need for a control line being run from the RCD to a power supply on the rig floor.

In some instances, an RCD includes an RCD body, a sealing element, and a bearing assembly disposed within the RCD body and supporting an inner mandrel to rotate relative to the RCD body. The sealing element is carried by the inner mandrel, and the bearing assembly includes a bearing sealed in an internal bearing fluid chamber, where in the internal bearing fluid chamber includes a bearing fluid maintained at a pressure greater than a pressure of wellbore fluid in an interior of the wellbore and/or an interior of the RCD body. At least a portion of the interior of the RCD body is exposed to the wellbore, which allows the wellbore fluid to flow into at least a portion of the RCD body.

Figure 2:
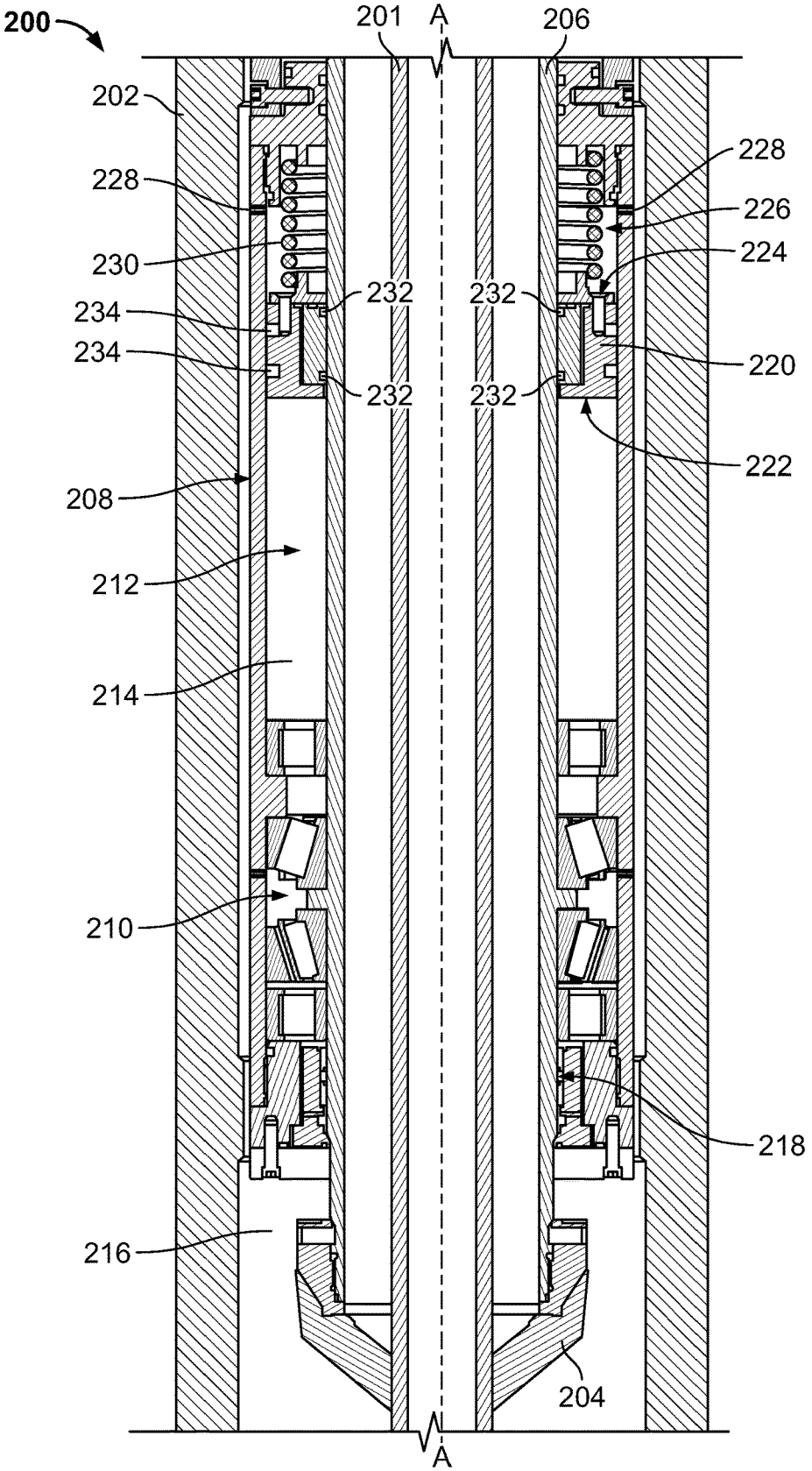
FIG. 2 is a partial half cross-sectional view of an example RCD that can be used in the example drilling system of FIG. 1.

FIG. 2 is a partial half cross-sectional view of an example RCD 200 that can be used in the example drilling system 100 of FIG. 1. The RCD 200 includes an RCD body 202, a sealing element 204 carried by an inner mandrel 206, and a bearing assembly 208 disposed within the RCD body 202 and supporting the inner mandrel 206 to rotate relative to the RCD body 202. The RCD body 202 is substantially cylindrical along a longitudinal axis A-A. The bearing assembly 208 includes a generally cylindrical housing disposed within the RCD body 202, where the bearing assembly can mount to an inner surface of the RCD body 202. In the example RCD 200 of FIG. 2, a gap (e.g., annulus) exists between an outer surface of the bearing assembly 208 and the inner surface of the RCD body 202, for example, to allow a flow of fluid through the gap. In some instances, no gap exists between the bearing assembly 208 and the RCD body 202 to resist a flow of fluid in the RCD body 202 uphole of the bearing assembly 208. A drilling string 201 is shown within the RCD body 202 and in sealing engagement with the sealing element 204. The drilling string 201 is cylindrical, and engages with the sealing element 204. The RCD body 202 can be integral to, mounted to, or otherwise connected to a riser, such as riser 108 of FIG. 1. The bearing assembly 208 includes a bearing 210 sealed in an internal bearing fluid chamber 212 that includes a bearing fluid 214 maintained at a first pressure greater than a second pressure of wellbore fluid 216 in an interior of the RCD body 202. The bearing assembly 208 also includes a dynamic seal 218 shown between the housing of the bearing assembly 208 and the inner mandrel 206 and exposed to relative movement between the bearing assembly 208 and the inner mandrel 206. The dynamic seal 218 separates the bearing fluid 214 in the internal bearing fluid chamber 212 and the wellbore fluid 216 in the interior of the RCD body 202. The dynamic seal 218 allows for leakage of bearing fluid 214 across the dynamic seal 218, so maintaining the bearing fluid 214 at a pressure greater than the wellbore fluid 216 across the dynamic seal 218 ensures that wellbore fluid 216 does not leak into the internal bearing fluid chamber 212.

The example RCD 200 includes a pressure compensating piston 220 to maintain the first pressure of the bearing fluid 214 greater than the second pressure of the wellbore fluid 216. The piston 220 is shown in the example RCD 200 as an annular piston that seals with the bearing assembly 208 (i.e., bearing assembly housing) and the inner mandrel 206. The RCD 200 creates and controls internal bearing pressure without the use of external control lines, for example, connecting the RCD bearing assembly 208 to a rig floor, by using the pressure compensating annular piston 220 integral to the bearing assembly 208. In the example RCD 200 of FIG. 2, the piston 220 is disposed between the internal bearing fluid chamber 212 and a wellbore fluid chamber 226, where the wellbore fluid chamber 226 is in fluid communication with the wellbore fluid 216 via one or more ports 228. The annular piston 220 is housed in a piston housing that is built into the design of (e.g., integral to) the bearing assembly 208 such that the bearing fluid 214 is exposed to a first end 222 of the piston 220 and the wellbore fluid 216 in the wellbore fluid chamber 226 is exposed to a second, opposite end 224 of the annular piston 220. The ports 228 can be cylindrical openings machined into the housing of the bearing assembly 208 to allow wellbore fluid 216 to pass into the wellbore fluid chamber 226 adjacent the second end 224 of the piston 220 in the bearing assembly 208. When wellbore fluid 216 enters into the wellbore fluid chamber 226, the pressure in the well is communicated to the annular piston 220 in the bearing assembly 208, which in turn is communicated to the bearing fluid 214 in the internal bearing fluid chamber 212. This can result in the internal bearing pressure being equal to the well bore pressure.

In the example RCD 200 of FIG. 2, a mechanical spring 230 acts on the piston 220 to bias the piston 220 to pressurize the bearing fluid 214 to the first pressure greater than the second pressure of the wellbore fluid 216. The spring 230 can be added to the second, opposite end 224 of the annular piston 220 (i.e., the wellbore fluid 216 side of the annular piston 220) so that the spring 230 applies a force against the annular piston 220 that is communicated to the bearing fluid 214 in the internal bearing fluid chamber 212. In some instances, by adding the spring force to the annular piston 220, the bearing fluid 214 pressure inside of the internal bearing fluid chamber 212 will be greater than the wellbore fluid 216 pressure by an amount equal to the force of the spring 230 divided by the area of the annular piston 220. By selecting the proper spring, a desired pressure deferential can be created inside of the bearing assembly 208. By creating the desired differential pressure in the bearing assembly 208, the life of the dynamic seal 218 can be maximized and contaminants can be prevented from entering the bearing assembly 208 (e.g., from entering the internal bearing fluid chamber 212). In some instances, RCD 200 is arranged so that the mechanical spring 230 produces a differential pressure across the piston 220 that is independent of the well bore fluid 216 pressure and based solely on the stiffness of the spring 230. In certain instances, the force of the mechanical spring 230 acting on the piston 220 could be additive to the wellbore pressure acting on the piston 220 and/or subtractive from the bearing fluid pressure acting on the piston 220. In the example RCD 200 of FIG. 2, the spring 230 is a compression spring disposed in the wellbore fluid chamber 226 and acting on the second end 224 of the piston 220. In some instances, the spring 230 includes a tension spring that acts to pull on the first end 222 of the piston 220.

In the example RCD 200 of FIG. 2, the inner diameter of the annular piston 220 includes seals 232 that seal against the rotating inner mandrel 206, while the outer diameter of the annular piston 220 includes seals 234 that seal against the stationary outer bearing housing. The bearing assembly 208 extends a longitudinal length along a central axis A-A of the RCD 200 beyond a length needed to house the bearing 210 to accommodate the internal bearing fluid chamber 212. For example, the bearing assembly 208 provides sufficient length of the internal bearing fluid chamber 212 so that bearing fluid 214 slowly, over time is leaked out of the bearing 210 and/or leaked out of the dynamic seal 218 and into the well bore, and the annular piston 220 translates along the length of the internal bearing fluid chamber 212 at least in part in response to leakage of the bearing fluid 214. When the bearing assembly 208 is first deployed in the RCD 200, the internal bearing fluid chamber 212 is full of the bearing fluid 214 with a very small wellbore fluid chamber 226 located on the well fluid side (i.e., the second end 224) of the annular piston 220. As time passes and internal bearing fluid 214 leaks out of the bearing assembly 208, the annular piston 220 travels toward the opposite end of its stroke (e.g., toward the internal bearing fluid chamber 212) until the internal bearing fluid chamber 212 is smaller and the wellbore fluid chamber 226 on the well fluid side of the annular piston becomes larger.

In some instances, the annular piston 220 can be substituted for a single oil chamber or multiple oil chambers, similar to a conventional hydraulic cylinder and piston. Although the example RCD 200 in FIG. 2 shows a single annular piston 220, in certain instances, the RCD 200 can include multiple pistons and/or multiple cylinders in the annular space inside of the RCD 200 or around the outside of the RCD body 202. However the cylinders are configured, internal porting, external hoses, or other fluid communication devices can communicate the wellbore fluid and bearing fluid to their respective chambers.

Figure 3:
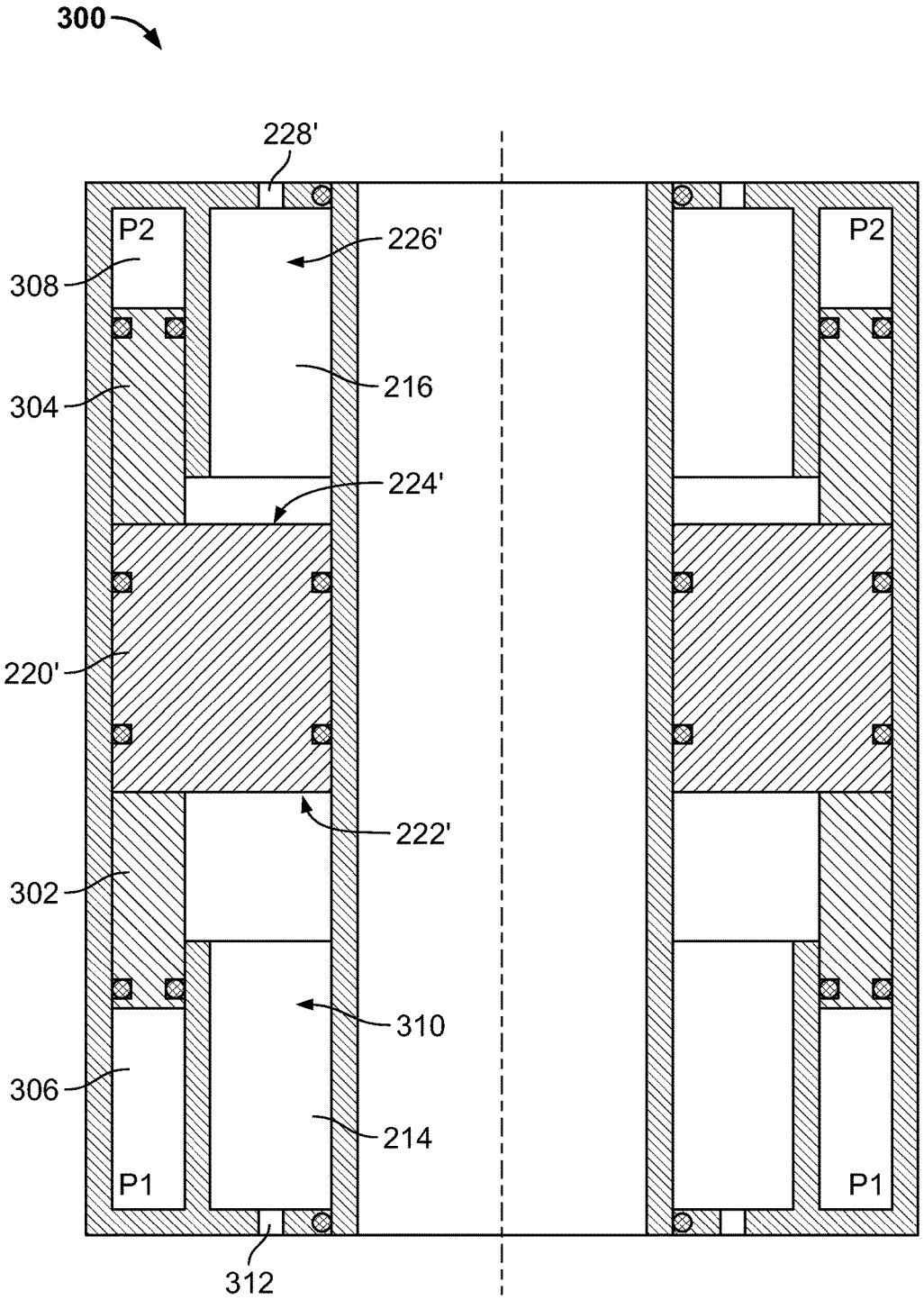
FIG. 3 is a partial half cross-sectional schematic view of an example RCD that can be used in the example drilling system of FIG. 1.

The piston 220 in the example RCD 200 can take a variety of forms, and can operate in a number of positions and configurations. In some instances, the annular piston 220 can include a protruding flange, ring, column, and/other protrusion extending from one or both of the first end 222 and the second end 224 that interact with a biasing force, for example, to supplement or replace the spring force from the spring 230. For example, FIG. 3 is a partial half cross-sectional schematic view of an example RCD 300 that can be used in the example drilling system 100 of FIG. 1. The example RCD 300 is like the example RCD 200 of FIG. 2, except the piston 220' of the example RCD 300 includes a first annular piston member 302 extending from the first end 222' of the piston 220' and a second annular piston member 304 extending from the second, opposite end 224' of the piston 220'. The first annular piston member 302 extends into a first chamber 306, and the second annular piston member 304 extends into a second chamber 308 adjacent the wellbore fluid chamber 226'. The first chamber 306 includes pressurized fluid at a first pressure (P1), and the second chamber 308 includes pressurized fluid at a second pressure (P2) to create a pressure differential across the piston 220' that acts to bias the piston 220' in pressurizing the bearing fluid 214 to a greater pressure than the wellbore fluid 216. In other words, the RCD 300 includes compressed gas or fluid in the first chamber 306 and second chamber 308 as a substitute for the mechanical spring 230 in the example RCD 200 of FIG. 2. In certain instances, the RCD 300 can also include a mechanical spring (like the mechanical spring 230 of FIG. 2) to bias the piston. In the example RCD 300 of FIG. 3, the pressurized fluids in the first and second chambers 306 and 308 exert a net force acting on the same side of the annular piston 220' as the well bore fluid 216. The well bore fluid 216 communicates the well bore pressure across the annular piston 220' and causes the pressure of the bearing fluid 214 to equal (substantially or exactly) the well bore fluid 216 pressure. The differential pressure in the fluids in the first chamber 306 and second chamber 308 supply an additional force that causes the bearing fluid 214 pressure to be greater than well bore fluid 216 pressure. In the example RCD 300 of FIG. 3, the additional annular chambers (e.g., first chamber 306 and second chamber 308) are shown on either end of the main annular piston 220', where the first annular piston member 302 and second annular piston member 304 extend from the first end 222' and the second end 224', respectively, of the piston 220'. The first annular piston member 302 and second annular piston member 304 essentially form a secondary annular piston that is able to translate back and forth, in parallel and in unison with the piston 220', between the first chamber 306 and the second chamber 308. The second chamber 308 is adjacent the well bore side (e.g., second end 224') of the main piston 220', and the fluid in the sealed second chamber 308 can be charged to a pressure (P2) that is greater than a charge (P1) in the first chamber 306 adjacent the bearing side (e.g., first end 222') of the main piston 220'. In some instances, this difference in pressure between P1 and P2 results in a bearing fluid 214 pressure that is greater than the wellbore fluid 216 pressure.

The example RCD 300 shows the wellbore fluid chamber 226' with ports 228' connecting the wellbore fluid chamber 226' to wellbore fluid 216 in the wellbore, and a secondary internal bearing fluid chamber 310 with a bearing fluid port 312 to communicate bearing fluid 216 into the secondary internal bearing fluid chamber 310 (e.g., from the internal bearing fluid chamber 212 of FIG. 2). However, the orientation of the wellbore fluid chamber 310 and/or the secondary internal bearing fluid chamber 310 can vary. For example, the secondary internal bearing fluid chamber 310 can be excluded such that, for example, the internal bearing fluid chamber directly communicates with the piston 220'.

In the example RCD 300 of FIG. 3, the first annular piston member 302 and second annular piston member 304 are positioned about a radially outward periphery of the piston 220'. However, the size, shape, and location of the first annular piston member 302 and second annular piston member 304 can be different, for example, based on different arrangements and embodiments of the RCD. In certain instances, the piston 220' excludes the first annular piston member 302 and/or the charged P1 fluid such that the piston 220' is biased by the charged P2 fluid on the second end of the piston 220' without bias on the first end of the piston 220'. In some instances, the secondary annular piston can be substituted for a single oil chamber or multiple oil chambers, similar to a conventional hydraulic cylinder and piston. Although the example RCD 300 in FIG. 3 shows a single annular piston 220' with a single secondary annular piston, in certain instances, the RCD 300 can include multiple secondary annular pistons and/or multiple cylinders in the annular space inside of the RCD 300 or around the outside of the RCD body. However the cylinders are configured, internal porting, external hoses, and/or other fluid communication devices can communicate the well bore fluid and bearing fluid to their respective chambers.

Figure 4:
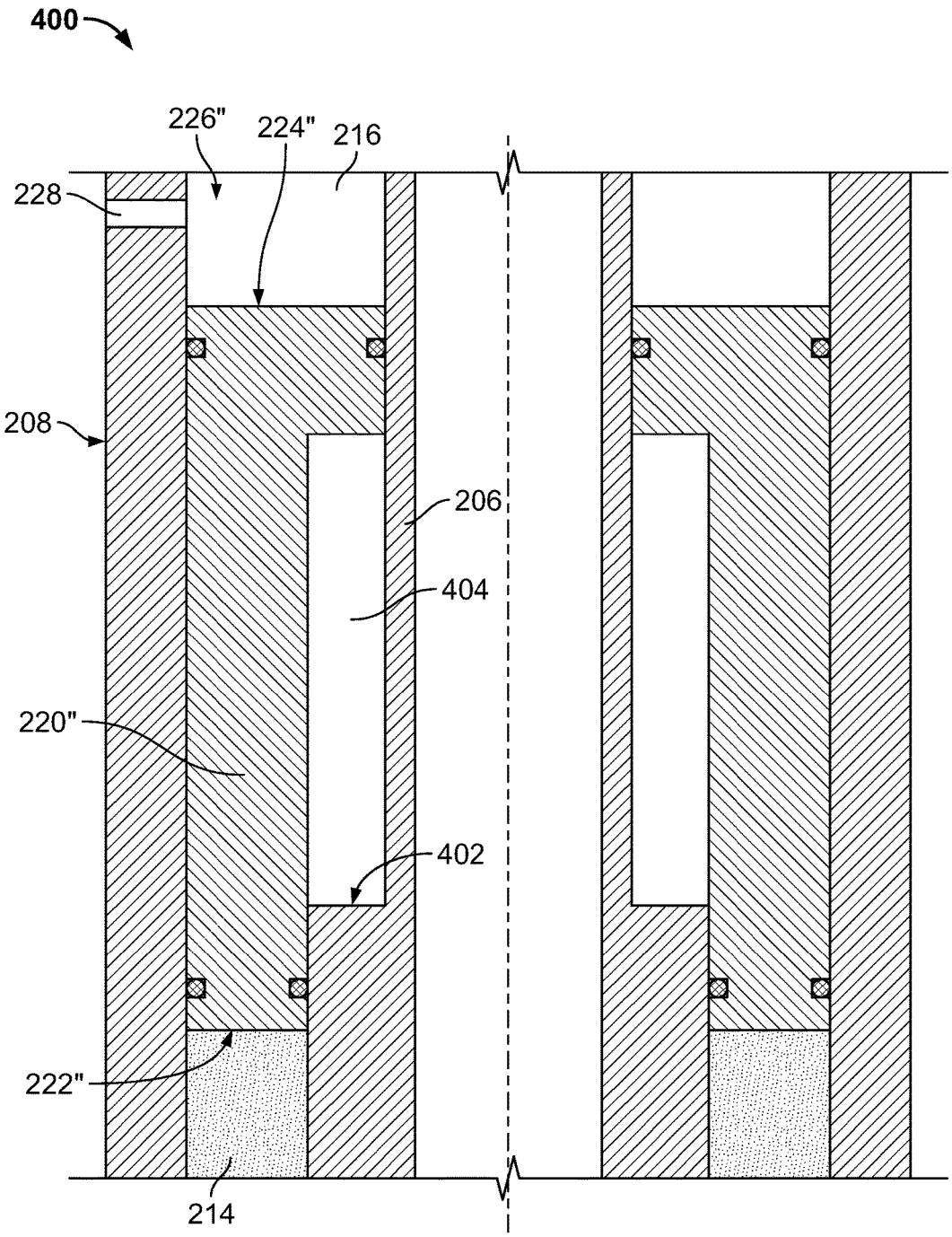
FIG. 4 is a partial half cross-sectional schematic view of an example RCD that can be used in the example drilling system of FIG. 1.

FIG. 4 is a partial half cross-sectional schematic view of another example RCD 400 that can be used in the example drilling system 100 of FIG. 1. The RCD 400 is like the example RCD 200 of FIG. 2, except the example RCD 400 optionally excludes the mechanical spring 230 of FIG. 2, and the piston 220" includes a differential area between the first end 222" and the second, opposite end 224" of the piston 220". The piston 220" is shown in the example RCD 400 as an annular piston that seals with the bearing assembly 208 (i.e., bearing assembly housing) and the inner mandrel 206. The first end 222" of the piston 220" has a smaller surface area than a surface area of the second, opposite end 224" of the piston 220" to create a positive differential pressure across the piston 220". The inner mandrel 206 includes a shoulder 402 that accounts for the smaller first end 222" of the piston 220" as compared to the larger second end 224" of the piston 220". The shoulder 402 forms a chamber 404 between the piston 220" and the inner mandrel 206. In some instances, the chamber 404 can include a pressurized fluid, can port to a source of pressurized fluid (e.g., accumulator), or can be empty. In the example RCD 400 of FIG. 4, the first end 222" of the piston 220" abuts an inner surface of the bearing assembly housing. However, in certain instances, the first end 222" can abut an outer surface of the inner mandrel 206, and the bearing assembly housing can include a shoulder to account for the smaller first end 222" as compared to the larger second end 224". In the example RCD 400 of FIG. 4, the area of the annular piston 220" on the side of the internal bearing fluid (i.e., the first end 222") will be less than the area of the annular piston 220" on the side of the well fluid (i.e., the second, opposite end 224"), which will result in the internal bearing fluid 214 pressure being greater than the well bore fluid 216 pressure. For example, since pressure is equal to a force times an area and the force acting on the annular piston 220" must be equal on both sides, a change in pressure can be created that is proportional to the ratio of the areas of the two sides (e.g., first end 222" and second end 224") of the annular piston 220". In some instances, the differential annular piston 220" area creates a differential pressure that varies in magnitude with well bore pressure, and the internal bearing fluid 214 pressure forms a ratio with the well bore fluid 216 pressure that is the inverse of the ratio of the area of the first end 222" and of the second end 224" of the annular piston 220". In the example RCD 400 of FIG. 4, the annular piston 220" is integral to the bearing assembly 208 and forms a seal between the inner diameter of the annular piston 220" and the rotating inner mandrel 206 and also forms a seal between the outer diameter of the annular piston 220" and the bearing assembly 208 housing inner diameter. In certain instances, the annular piston 220" of FIG. 4 can be substituted into the bearing assembly 208 of FIG. 2 with a few minor modifications to the bearing assembly 208 housing and the inner mandrel 206 geometry.

FIG. 4 shows the piston 220" with a differential area between the two sides of the piston 220". In some instances, the piston 220" can include additional or different features. For example, the geometry of the piston 220" can include a rod side and a piston side similar to a conventional hydraulic cylinder. In this example, the rod end of the piston is disposed on the bearing fluid side of the chamber and can reduce the area acted on by the bearing fluid so that well bore pressure is amplified. In certain instances, the annular piston 220" can be substituted for a single oil chamber or multiple oil chambers, similar to a conventional hydraulic cylinder and piston. For example, instead of a single annular piston, it can be desirable to arrange a number of cylinders in the annular space inside of the RCD or around the outside of the RCD body. However the cylinders are configured, either internal porting or external hoses, for example, can communicate the well bore fluid and bearing fluid to their respective chambers.

Figure 5:
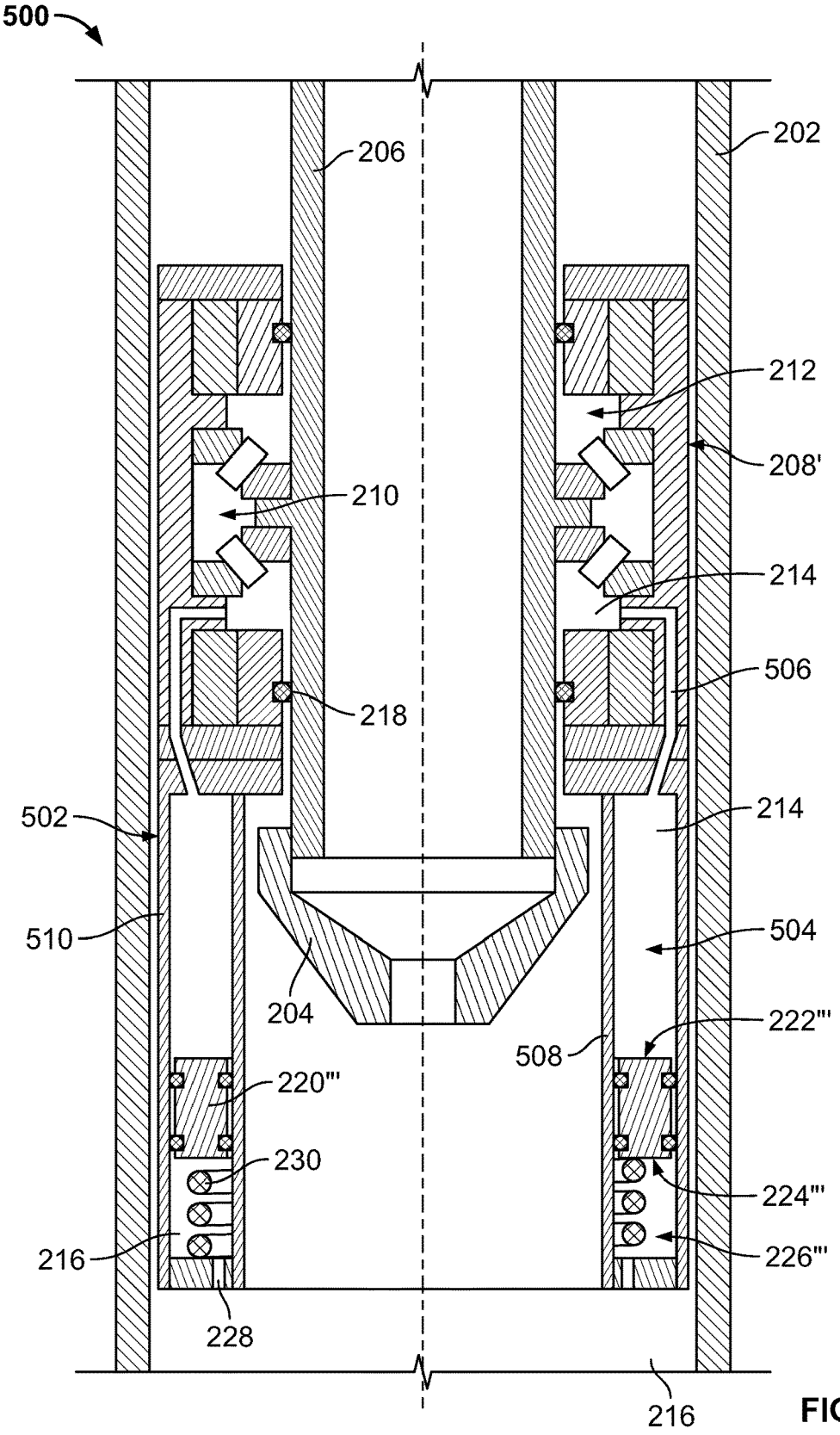
FIG. 5 is a partial half cross-sectional view of an example RCD that can be used in the example drilling system of FIG. 1.

FIG. 5 is a partial half cross-sectional schematic view of an example RCD 500 that can be used in the example drilling system 100 of FIG. 1. The example RCD 500 is like the example RCD 200 of FIG. 2, except the piston 220'" of the example RCD 500 is not integral to the bearing assembly 208'. The RCD 500 includes a separate piston housing 502 separate from (e.g., below, or downhole of) the bearing assembly 208'. The piston housing 502 houses the piston 220'". The piston housing 502 includes a secondary bearing fluid chamber 504 in fluid communication with the internal bearing fluid chamber 212 through a bearing fluid port 506. The bearing fluid port 506 allows bearing fluid 214 to flow between the internal bearing fluid chamber 212 and the secondary bearing fluid chamber 504 such that the pressure of the bearing fluid 214 is imparted on the first end 222'" of the piston 220'". The piston housing 502 also includes the wellbore fluid chamber 226'" in fluid communication with the wellbore fluid 216 via the one or more ports 228. The pressure of the wellbore fluid 216 is imparted on the second, opposite end 224'" of the piston 220'". The wellbore fluid chamber 226'" also includes the mechanical spring 230 to bias the piston 220'" to pressurize the bearing fluid 214 to a pressure greater than the pressure of the wellbore fluid 216 in the wellbore fluid chamber 226'". FIG. 5 shows the example RCD 500 with the piston housing 502 separate from the bearing assembly 208'. In some instances, the annular piston 220'" could be located in a piston housing that is mounted to the top, bottom, or both sides of the bearing assembly 208' (e.g., rather than be integral to the bearing assembly 208'). In certain instances, one end of the piston housing 502 includes porting (e.g., ports 228) that exposes the wellbore fluid chamber 226'" and one side of the annular piston 220'" to well fluid and well bore pressure while at the other end of the piston housing 502 is porting (e.g., bearing fluid port 506) that exposes the secondary bearing fluid chamber 504 and the other side of the annular piston 220'" to the internal bearing fluid of the bearing assembly 208'. The inner diameter of the annular piston 220'" seals against an inner stationary wall 508 of the piston housing 502, and the outer diameter of the annular piston 220'" seals against an outer stationary wall 510 of the piston housing 502. The annular piston 220'" and piston housing 502 can be cylindrical in shape with a hollow center to allow a drill string to pass through. In some instances, the piston housing 502 is sized based on the needs of a particular job. For example, in instances where low well bore pressures are expected, an operator can choose to use a smaller piston housing (i.e., piston chamber) while in instances where high well bore pressures are expected, an operator can choose to use a larger piston housing (e.g., piston chamber) assembly to allow for greater amounts of internal bearing fluid leakage. Similar to the example RCD 200 of FIG. 2, the example RCD 300 of FIG. 3, and the example RCD 400 of FIG. 4, a mechanical spring, gas charged chambers, and/or a piston with differential area could be used to provide a positive differential pressure inside of the bearing assembly 208' to ensure the well fluid and other contamination do not enter the bearing assembly 208'.

Figure 6:
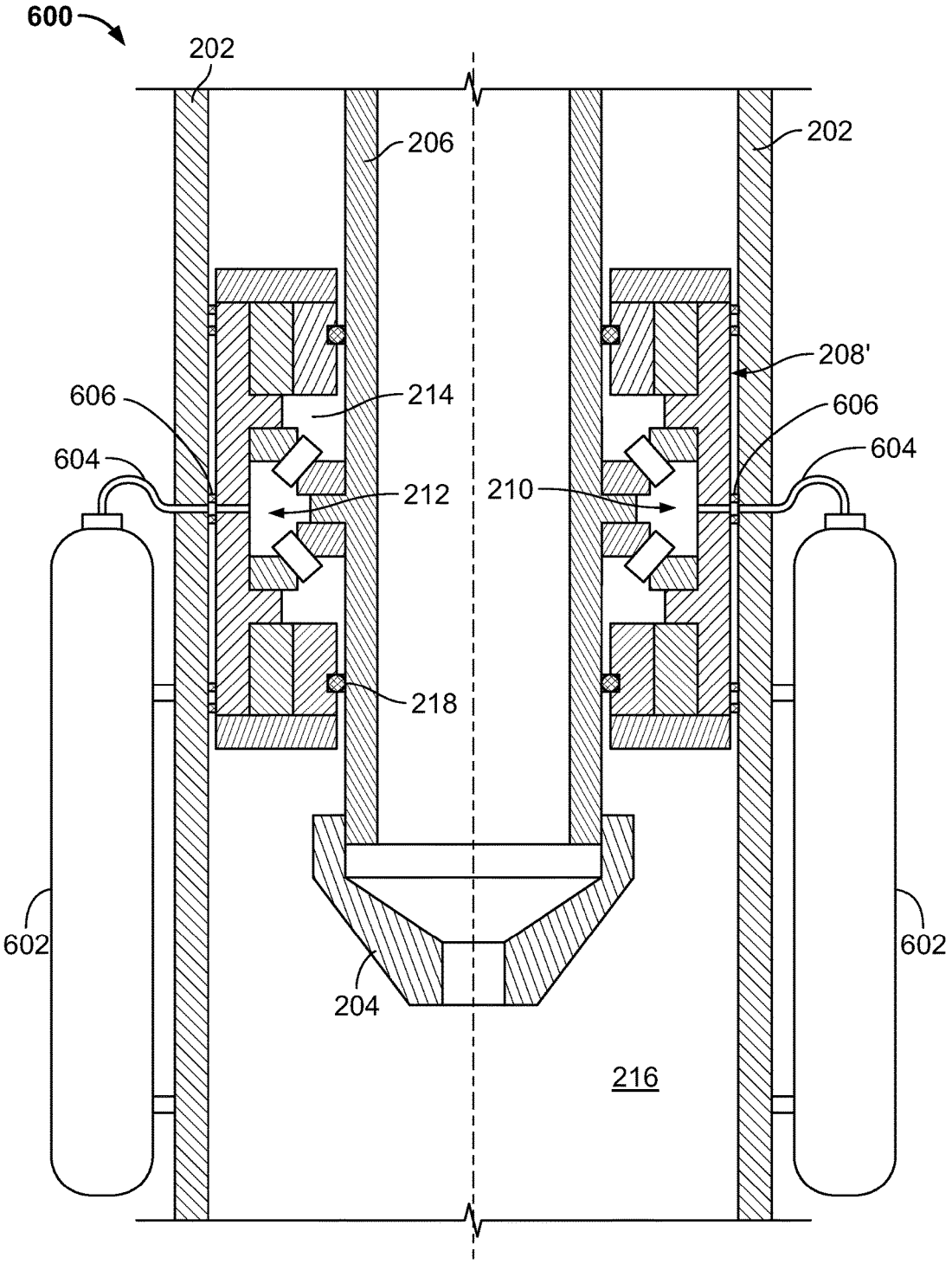
FIG. 6 is a partial half cross-sectional view of an example RCD that can be used in the example drilling system of FIG. 1.

FIG. 6 is a partial half cross-sectional view of an example RCD 600 that can be used in the example drilling system of FIG. 1. The example RCD 600 is like the example RCD 500 of FIG. 5, except the example RCD 600 excludes a piston and piston housing, but includes two sealed pressure chambers 602 with flow ports 604 fluidly communicating the sealed pressure chambers 602 with the internal bearing fluid chamber 212. The RCD 600 includes seals 606 about the flow ports 604 (e.g., between the RCD body 202 and the bearing assembly 208') to seal the flow ports 604 from wellbore fluid 216 in the interior of the RCD body 202. The sealed pressure chambers 602 are disposed closer to the RCD body 202 than a top surface of the wellbore. For example, FIG. 6 shows the sealed pressure chambers 602 mounted to an exterior of the RCD body 202 adjacent to the bearing assembly 208'. In some instances, the sealed pressure chambers 602 are a bank of accumulators attached to the outside of the RCD body or some other location very near the RCD body as a power supply for internal bearing pressure. A bank of accumulators can mount on the RCD body 202 and be charged to a desired pressure. When the bearing assembly 208' is landed in the RCD body 202, the flow ports 604 can be energized to communicate the pressure in the accumulator bottles to the bearing fluid 214 in the bearing assembly 208'. In some instances, a hydraulic circuit with a proportional control can be incorporated into the RCD 600 so that the pressure being delivered to the bearing assembly 208' from the sealed pressure chambers 602 (e.g., accumulators) is always greater than the well bore pressure. The hydraulic circuit would have the ability to monitor well bore pressure and adjust the bearing pressure so that it maintains a desired amount of pressure greater than well bore pressure.

In view of the discussion above, certain aspects encompass a rotating control device (RCD) for use in drilling a wellbore. The RCD includes an RCD body, a sealing element, and a bearing assembly disposed within the RCD body and supporting an inner mandrel to rotate relative to the RCD body. The sealing element is carried by the inner mandrel, and the bearing assembly includes a bearing sealed in an internal bearing fluid chamber. The internal bearing fluid chamber includes a bearing fluid maintained at a first pressure greater than a second pressure of wellbore fluid in an interior of the RCD body by a pressure compensating piston between the bearing fluid contacting a first end of the piston and the wellbore fluid contacting a second, opposite end of the piston.

Certain aspects encompass a method including receiving a pressure from a wellbore fluid in a wellbore on a bearing system of a rotating control device (RCD). The RCD includes an RCD body, a sealing element, and a bearing assembly disposed within the RCD body and supporting an inner mandrel to rotate relative to the RCD body, where the sealing element is carried by the inner mandrel, and the bearing assembly includes a bearing sealed in an internal bearing fluid chamber. The method includes maintaining a pressure of the bearing fluid within the internal bearing fluid chamber greater than a pressure of the wellbore fluid in an interior of the RCD body.

Certain aspects encompass a rotating control device (RCD) for use in drilling a wellbore, the RCD including an RCD body, a sealing element, and a bearing assembly disposed within the RCD body and supporting an inner mandrel to rotate relative to the RCD body. The sealing element is carried by the inner mandrel, and the bearing assembly includes a bearing sealed in an internal bearing fluid chamber. The internal bearing fluid chamber includes a bearing fluid maintained at a first pressure greater than a second pressure of wellbore fluid in an interior of the RCD body by fluid in a sealed pressure chamber in fluid communication with the internal bearing fluid chamber.

The aspects above can include some, none, or all of the following features.

The piston can be disposed between the internal bearing fluid chamber and a wellbore fluid chamber in fluid communication with the wellbore fluid, the piston biased to pressurize the bearing fluid in the internal bearing fluid chamber to the first pressure greater than the second pressure of the wellbore fluid. The wellbore fluid chamber can include a flow port to the interior of the RCD body to allow wellbore fluid to flow into the wellbore fluid chamber. The piston can be housed in a piston housing integral with the bearing assembly. The piston can be housed in a piston housing apart from the bearing assembly. The RCD can include a flow port connecting the bearing fluid in the internal bearing fluid chamber to a chamber in the piston housing about the first end of the piston to allow bearing fluid to flow about the first end of the piston. The RCD can include a spring acting on the piston to bias the piston to pressurize the bearing fluid to the first pressure greater than the second pressure of the wellbore fluid. The spring can include a compression spring to push against the second, opposite end of the piston. The spring can include a tension spring acting to pull on the first end of the piston. The piston can include an annular piston member extending into a sealed annular chamber including a fluid at a third pressure, the fluid at the third pressure configured to bias the piston to pressurize the bearing fluid to the first pressure greater than the second pressure of the wellbore fluid. The annular piston member disposed in the sealed annular chamber contacts the fluid at the third pressure at a third end of the annular piston member and contacts a fluid at a fourth pressure at a fourth, opposite end of the annular piston member, the third pressure being greater than the fourth pressure. A first surface area of the first end of the piston contacting the bearing fluid is greater than a second surface area of the second, opposite end of the piston contacting the wellbore fluid. The rotating control device can be free from control lines exterior to the rotating control device to maintain the bearing fluid at the first pressure. The sealed pressure chamber can include an accumulator including the bearing fluid. The sealed pressure chamber can be disposed closer to the RCD body than a top surface of the wellbore. The RCD can include a pressure compensating piston between the bearing fluid contacting a first end of the piston and the wellbore fluid contacting a second, opposite end of the piston, and maintaining a pressure within the internal bearing fluid chamber greater than a pressure of the wellbore fluid in an interior of the RCD body can include pressurizing the bearing fluid in the internal bearing fluid chamber with the piston to a first pressure greater than a second pressure of the wellbore fluid. Pressurizing the bearing fluid in the internal bearing fluid with the piston can include biasing the piston with at least one of a spring acting on the piston, a fluid in a sealed pressure chamber acting on the piston, or a differential area between the first end and the second, opposite end of the piston. Maintaining a pressure within the internal bearing fluid chamber greater than a pressure of the wellbore fluid in an interior of the RCD body can include pressurizing the bearing fluid in the internal bearing fluid chamber with bearing fluid in a sealed pressure chamber in fluid communication with the internal bearing fluid chamber, where the sealed pressure chamber is disposed closer to the RCD body than a top surface of the wellbore.

A number of embodiments have been described. Nevertheless, it will be understood that various modifications may be made. Accordingly, other embodiments are within the scope of the following claims.

What is claimed is:

1. A rotating control device (RCD) for use in drilling a wellbore, the device comprising:

a RCD body;

a sealing element; and a bearing assembly disposed within the RCD body and supporting an inner mandrel to rotate relative to the RCD body, the sealing element carried by the inner mandrel, the bearing assembly comprising a bearing sealed in an internal bearing fluid chamber, the internal bearing fluid chamber comprising a bearing fluid maintained at a first pressure greater than a second pressure of wellbore fluid in an interior of the RCD body by a pressure compensating piston between the bearing fluid contacting a first end of the piston and the wellbore fluid contacting a second end of the piston opposite to the first end of the piston, wherein the piston is disposed between the internal bearing fluid chamber and a wellbore fluid chamber in fluid communication with the wellbore fluid, the piston biased to pressurize the bearing fluid in the internal bearing fluid chamber to the first pressure greater than the second pressure of the wellbore fluid.

2. The rotating control device of claim 1, wherein the wellbore fluid chamber comprises a flow port to the interior of the RCD body to allow wellbore fluid to flow into the wellbore fluid chamber.

3. The rotating control device of claim 1, wherein the piston is housed in a piston housing integral with the bearing assembly.

4. The rotating control device of claim 1, wherein the piston is housed in a piston housing apart from the bearing assembly.

5. The rotating control device of claim 4, comprising a flow port connecting the bearing fluid in the internal bearing fluid chamber to a chamber in the piston housing about the first end of the piston to allow bearing fluid to flow about the first end of the piston.

6. The rotating control device of claim 1, comprising a spring acting on the piston to bias the piston to pressurize the bearing fluid to the first pressure greater than the second pressure of the wellbore fluid.

7. The rotating control device of claim 6, wherein the spring comprises a compression spring to push against the second, opposite end of the piston.

8. The rotating control device of claim 6, wherein the spring comprises a tension spring acting to pull on the first end of the piston.

9. The rotating control device of claim 1, the piston further comprising an annular piston member extending into a sealed annular chamber comprising a fluid at a third pressure, the fluid at the third pressure configured to bias the piston to pressurize the bearing fluid to the first pressure greater than the second pressure of the wellbore fluid.

10. The rotating control device of claim 9, wherein the annular piston member disposed in the sealed annular chamber contacts the fluid at the third pressure at a third end of the annular piston member and contacts a fluid at a fourth pressure at a fourth, opposite end of the annular piston member, the third pressure being greater than the fourth pressure.

11. The rotating control device of claim 1, wherein a first surface area of the first end of the piston contacting the bearing fluid is greater than a second surface area of the second, opposite end of the piston contacting the wellbore fluid.

12. The rotating control device of claim 1, wherein the rotating control device is free from control lines exterior to the rotating control device to maintain the bearing fluid at the first pressure.

13. A method comprising:

receiving a pressure from a wellbore fluid in a wellbore on a bearing system of a rotating control device (RCD), the rotating control device comprising a RCD body, a sealing element, and a bearing assembly disposed within the RCD body and supporting an inner mandrel to rotate relative to the RCD body, the sealing element carried by the inner mandrel, the bearing assembly comprising a bearing sealed in an internal bearing fluid chamber; and maintaining a pressure of the bearing fluid at a first pressure within the internal bearing fluid chamber greater than a second pressure of the wellbore fluid in an interior of the RCD body by a pressure compensating piston between the bearing fluid contacting a first end of the piston and the wellbore fluid contacting a second end of the piston opposite the first end of the position, wherein the piston is disposed between the internal bearing fluid chamber and a wellbore fluid chamber in fluid communication with the wellbore fluid, the piston biased to pressurize the bearing fluid in the internal bearing fluid chamber to the first pressure greater than the second pressure of the wellbore fluid.

14. The method of claim 13, wherein pressurizing the bearing fluid in the internal bearing fluid with the piston comprises biasing the piston with at least one of a spring acting on the piston, a fluid in a sealed pressure chamber acting on the piston, or a differential area between the first end and the second, opposite end of the piston.

15. The method of claim 13, wherein maintaining a pressure within the internal bearing fluid chamber greater than a pressure of the wellbore fluid in an interior of the RCD body comprises pressurizing the bearing fluid in the internal bearing fluid chamber with bearing fluid in a sealed pressure chamber in fluid communication with the internal bearing fluid chamber, and wherein the sealed pressure chamber is disposed closer to the RCD body than a top surface of the wellbore.

* * * * *